United States Patent [19]

Forti et al.

[11] Patent Number: 4,706,070

[45] Date of Patent: Nov. 10, 1987

[54] OUTBOARD MOTOR ALARM SYSTEM

[75] Inventors: Steven A. Forti, Norwell; Robert F. McNulty, Jr., Brewster, both of Mass.

[73] Assignee: Eclipse Technologies, Norwell, Mass.

[21] Appl. No.: 892,274

[22] Filed: Aug. 4, 1986

[51] Int. Cl.[4] ..... G08B 21/00; G08B 13/14

[52] U.S. Cl. ..... 340/568; 340/652; 340/693; 340/984

[58] Field of Search ..... 340/568, 693, 652, 984

[56] References Cited

U.S. PATENT DOCUMENTS

| | | | |
|---|---|---|---|
| 3,696,371 | 10/1972 | Wise | 340/568 |
| 3,742,480 | 6/1973 | Hoecker | 340/568 |
| 3,824,575 | 7/1974 | Rich | 340/984 |
| 4,151,506 | 4/1979 | Schoenmetz | 340/63 |
| 4,250,501 | 2/1981 | Pokrandt | 340/664 |
| 4,274,077 | 6/1977 | Felger | 340/63 |
| 4,327,360 | 4/1982 | Brown | 340/571 |
| 4,329,681 | 5/1982 | Parsons | 340/568 |

*Primary Examiner*—Glen R. Swann, III

[57] ABSTRACT

A self-contained alarm system mounted in a housing is adapted to be mounted between the clamps of an outboard motor and the transom of a boat. The clamps of the outboard motor are electrically coupled to circuit means in the housing of the alarm system through electrically conductive sensor members in the housing. The circuit means acts as a discontinuity or open circuit detector. When a clamp of the outboard motor is backed off, either intentionally or accidentally, the circuit means electrically detects the change of resistance and activates a sound device located in the housing.

20 Claims, 4 Drawing Figures

OUTBOARD MOTOR ALARM SYSTEM

BACKGROUND OF THE INVENTION

The present invention relates to a portable and removable alarm system for an outboard motor.

More particularly, the alarm system of the present invention is mounted between the clamps of an outboard motor and the transom of a boat.

A common type of pleasure boating provides outboard motors attached to the transom for propelling the boat through the water. Such motors are typically clamped to the transom of the boat and may readily be removed from the boat for storage, cleaning, and repair. However, the outboard motors are frequently left upon the boats for long periods of time when not in use. Such unattended outboard motors have proven to be the target of thieves.

In the past, a variety of alarm systems were known, such as providing a chain and lock system in which a chain was used to lock the motor to the boat. Since chains can be rapidly and quietly sawed, such a system has not prevented such thefts from taking place. In addition, such a system was useless in giving an indication that, during use, the clamps of the outboard motor were coming loose.

U.S. Pat. 3,696,371 discloses an outboard motor theft alarm system which includes a switch actuated by the motor clamp of the outboard motor. The switch is preferably mounted in the transom of the boat so that it is held in its open position by the outboard motor clamps. When the motor clamps are loosened a sufficient amount, the switch moves to its closed position and an electrical circuit is completed. The switch is connected to an alarm such as a boat horn or separate alarm system. Such an alarm system will not adequately detect loose clamps and suffers from the unreliability associated with mechanical components. The system may also be defeated by interrupting the electrical system unless additional shielding is provided. Further, such a hard-wired system is not readily mounted and removable as an integral unit.

SUMMARY OF THE INVENTION

Briefly stated, and according to an embodiment of this invention, the problems with prior art devices have been overcome by the practice of this invention which provides an alarm system for an outboard motor taking advantage of an electrically conductive housing electrically coupled to electrically conductive clamps for mounting the motor to the transom of the boat. The self-contained portable and readily removable alarm system includes a housing adapted to be mounted between the clamps of the outboard motor and the transom of the boat. The housing includes electrically conductive sensor members which are mechanically and electrically connectable to the clamps of the outboard motor. The housing also includes an inaccessible compartment for mounting a portable power source and an inaccessible compartment for mounting a signalling means. A circuit means is also inaccessibly located in the housing when the housing is mounted between the clamps of the outboard motor and the transom of the boat. The circuit means is electrically connected to the electrically conductive sensor members, the power source, and the signalling means to provide an open circuit detection system. When either clamp of the outboard motor is mechanically backed off, the electrical resistance between either clamp and its respective electrically conductive sensor member is increased beyond a predetermined range, and the signalling means is activated to provide an alarm.

It is therefore an object of this invention to provide an easy-to-use, self-contained alarm system for an outboard motor.

It is a further object of this invention to provide a portable, self-contained alarm system which cannot be readily defeated.

It is a still further object of this invention to provide an outboard motor alarm system which has the sensitivity to determine if the outboard motor, in use, is not adequately secured to the transom of the boat.

The invention both as to its organization and principle of operation, together with further objects and advantages thereof, may better be understood by reference to the following detailed description of an embodiment of the invention, taken in conjunction with an accompanying drawing, in which:

DETAILED DESCRIPTION OF THE PREFERRED EMBODIMENT

Figure 1:
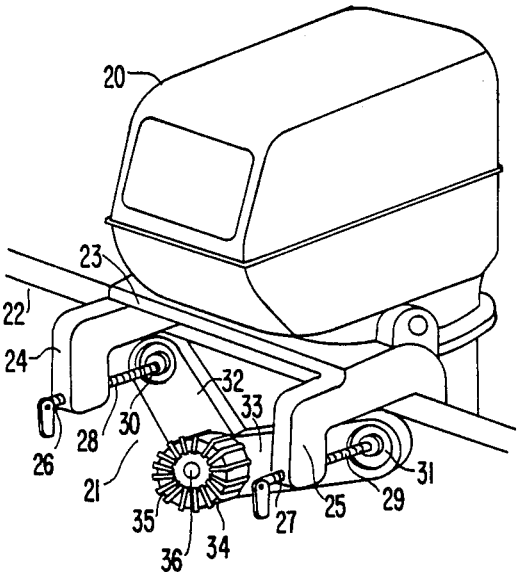
FIG. 1 is a perspective view of the outboard motor alarm system in accordance with this invention.

Referring to FIG. 1 of the drawing, an outboard motor 20 mechanically couples an alarm housing 21 to the transom 22 of a boat.

The outboard motor 20 may be of a variety of types and provide a wide range of horsepower to a propeller (not shown). The outboard motor 20, although often heavy and bulky, is considered to be portable. The outboard motor 20 includes a clamping structure typically made up of a cross-member 23 having first and second downwardly angled members 24 and 25, respectively, disposed from either end of the cross-member 23. The cross-member 23 and the angled members 24 and 25 are all typically formed of the same material such as stainless steel. The clamping structure, made up of the cross-member 23 and the first and second angled members 24 and 25, is typically electrically conductive.

Disposed in the free ends of the first and second angle members 24 and 25 are threaded apertures 26 and 27. Threaded through the apertures 26 and 27 are clamps 28 and 29. The clamps 28 and 29 are typically formed of an electrically conductive material such as aluminum. At the free end of clamps 28 and 29 are integrally formed pad members 30 and 31, respectively. The pad members 30 and 31 are likewise formed on an electrically conductive material such as aluminum. Thus, an electrical connection is capable of being formed between pad member 30 and pad member 31 through the clamping structure made up of the first and second angled members 24 and 25 and cross-member 23 and clamps 28 and 29.

The alarm housing 21 is formed of a tough polycarbonate material and includes first arm portion 32 and second arm portion 33 pivotally connected to a central pivot portion 34 having a decorative horn housing 35 and a centrally disposed shield member 36.

Figure 2:
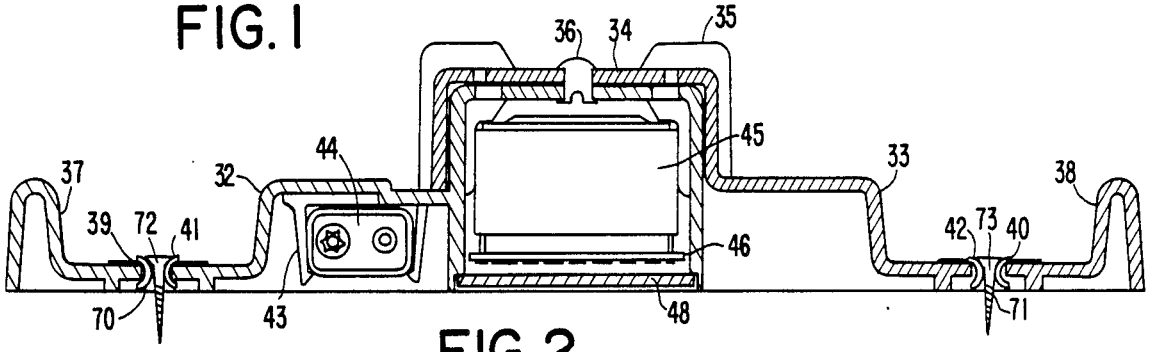
FIG. 2 is a sectional view of the housing of the alarm system, in accordance with this invention.

At the free end of each arm portion 32 and 33 is a first and second cup-shaped depression 37 and 38, respectively, best seen in FIG. 2. The first and second cup-shaped depressions 37 and 38 include first and second electrically conductive sensor members 39 and 40, respectively. The cup-shaped depressions 37 and 38 are of a sufficient depth to require several full turns of the clamps 28 and 29 before the pad members 30 and 31 clear the alarm housing. This assures that the alarm will be activated well prior to the removal of the outboard motor 20 and for a long enough period of time prior to any attempt to destroy or discard (e.g. sink) the alarm unit.

The depth of the cup-shaped depressions 37 and 38 also provides further integrity to the clamping structure by trapping a suddenly loosened clamp, thereby aiding in preventing the accidental loss, in use, of the outboard motor. The sensor members 39 and 40 may each be formed from a rivet and are so shaped to provide sufficient surface area 41 and 42 to assure a good electrical connection with the generally disk-shaped pad members 30 and 31 of clamps 28 and 29. Preferably the sensor members are formed of a material such as stainless steel.

In a preferred embodiment, best seen when referring to FIG. 2, the sensor members 39 and 40 include apertures or hollow portions 70 and 71, respectively, through which fastening means such as screws 72 and 73 firmly attach the housing 21 to the transom 22 of the boat. Attaching the housing 21 firmly to the transom 22 at sensor members 39 and 40 adds significant strength and integrity to the clamping structure. When the housing 21 is permanently attached to the transom 21, accidental disengagement of the outboard motor, in use, is significantly lessened. Since the housing 21 is securely attached to the transom 23, even if both clamps suddenly loosened, the depth of the cup-shaped depressions 37 and 38 would trap the clamps and substantially prevent the outboard motor from disengaging from the transom.

Referring to FIG. 2, the cross-section of the alarm housing 21 is shown with the first and second arm portions 32 and 33 in axial alignment. That is, the centerline distance of sensor members 39 and 40 are at their maximum distance from one another.

A compartment 43 is located inside of the housing 21 and provides the releasable mounting of a power source such as a 9 volt battery 44. The battery 44 may be shielded by compartment 43 and housing 21 in order to prevent the shorting of the terminals of battery 44 when the housing 21 becomes wet. The battery 44 is releasably connected in the compartment 43 to include its terminals in a downstanding position. Further, drain holes may be included in compartment 43 or other appropriate places in housing 21. When the alarm housing 21 is mounted between the clamps 28 and 29 of the outboard motor 20 and the transom 22 of the boat, the battery 44 is inaccessible. The battery 44 is readily accessible for replacement by the consumer through the open back of the alarm unit.

The central pivot portion 34 defines an internal housing for receiving a signalling means 45 for providing an alarm signal when activated. The signalling means 45 is also inaccessibly located when the alarm housing 21 is mounted between the clamps 28 and 29 of the outboard motor 20 and the transom 22 of the boat. Signalling means 45 may take a variety of forms such as a three-terminal piezo-electric horn.

Disposed through the housing 21 at the central pivot portion 34 and directly above the horn 45 is shield member 36 which may be in the form of a rivet. The shield member 36 is positioned over the diaphragm portion of the horn 45 in order to substantially prevent puncture of the diaphragm horn through the housing 21 to deter the disarming of the horn 45 during a theft.

Also enclosed in the compartment defined by central pivot portion 34, and structurally attached to the horn 45, is circuit means 46. The circuit means 46, which is better described when referring to FIG. 4, may include one or more integrated circuits and be encapsulated or otherwise sealed against corrosive elements. The alarm signal is emitted through a piezo-electric star horn which emits a 90 Db. intermittent signal when activated. The emitter diaphragm of the horn 45 may include drain holes or vents to allow drainage of moisture which may collect. A cover 48 is provided to further protect the circuit means 46.

Figure 3:
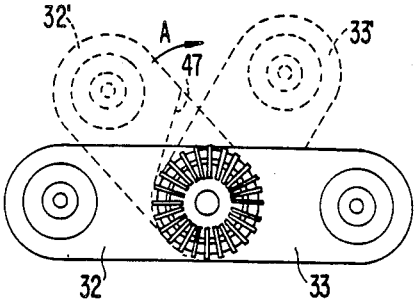
FIG. 3 is a top view of the housing of the alarm system showing the, arms in various positions, in accordance with this invention.

Referring to FIG. 3, arm portions 32 and 33 are shown, in solid lines, in their fully extended or axially aligned position. When the arm portions 32 and 33 are pivoted toward each other, such as in the direction of arrow A, they will have a shorter centerline distance such as shown in arm portions 32' and 33' shown in dotted lines. The adjustability of the arm portions 32 and 33 is important to provide a variety of centerline distances between sensor members 39 and 40 to accommodate the proper alignment with various clamp centerline distances in a variety of outboard motors. Clamp centerline distances typically range from about 4 inches minimum to about 8 inches maximum when fully opened. The arm portions 32 and 33 can be formed with integrally molded abutments or stops such as stop 47, resulting in the minimum centerline distance to limit the travel between arms 32 and 33.

Figure 4:
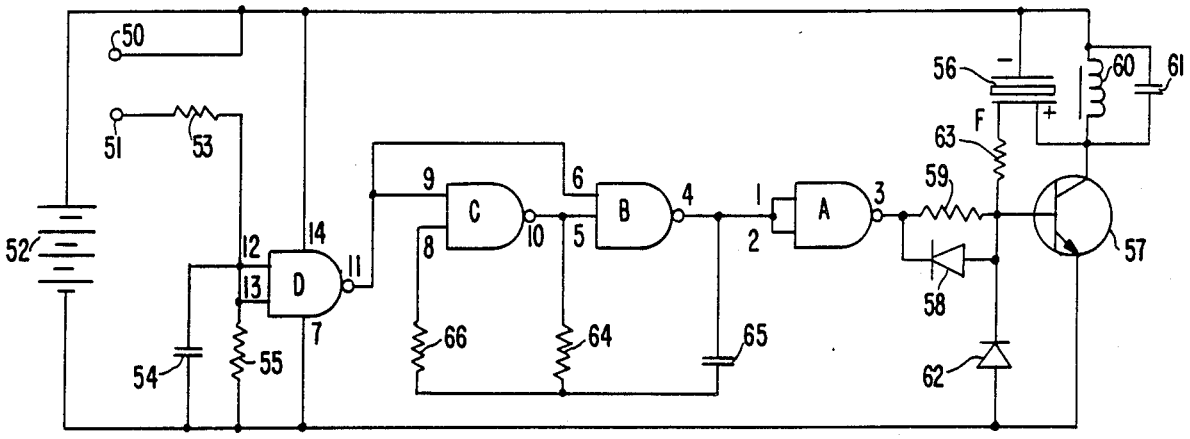
FIG. 4 is a schematic representation of the circuit means of the alarm system, in accordance with this invention.

Referring now to FIG. 4, a circuit means is shown having first control lead 50 and second control lead 51. The control leads are electrically connected to sensor members, such as sensor members 39 and 40, as shown in FIG. 2. Control lead 50 is electrically connected to the anode of a battery 44, and control lead 51 is electrically connected to the cathode of battery 44 through the series connection of resistor 53 and the parallel connection of capacitor 54 and resistor 55. Resistor 53 and capacitor 54 function as an RC filter in order to remove damaging transients (noise) which may appear at the control leads 50 and 51. Resistor 53 may have a value of 220K ohms, and capacitor 54 may have the value of 0.1 microfarads.

Inverters A, B, C, and D are preferably formed from an integrated circuit chip such as integrated circuit 4011B, manufactured by Motorolla. The pin numbers 1 through 13 are those pin numbers designated with the chip.

Inverter D, with its dropping resistor 55, having a value such as 2.2M ohms, functions as a high input impedence switch controlling the three-terminal piezo-e1ectr1c horn 45. When the control leads 50 and 51 are shorted, the output of inverter or gate D is forced low causing the alarm to remain off and in a low quiescent current standby mode. Opening the control leads 50 and 51 allows the input of inverter D to be pulled down by resistor 55 causing the output of inverter D to go high, turning on the modulating oscillator (inverters C and B) and the main piezo driver oscillator (inverter A), to be described subsequently. Resistor 55 also sets the sensitivity of the system. The value of resistor 55 varies directly with the alarm system's ability to tolerate resistive connections in the control leads 50 and 51. The life of battery 44 increases with the resistive value of resistor 55.

Inverters C and B form a free-running multivibrator and are arranged in a C MOS oscillator configuration. They function to provide on-off modulation at a frequency of approximately 10 HZ, making the alarm tone more alerting. The oscillating frequency is determined by the value of resistor 64 and of capacitor 65. Resistor 66 limits the current through protective diodes (not shown) on the input of inverter C as well as reducing the variation in oscillating frequency between units to make the unit independent of supply voltage variations. Resistor 66 is chosen to be at least twice as large as resistor 64. Resistor 64 may have a value of 150K ohms; resistor 66 may have a value of 3.9M ohms; and capacitor 65 may have a value of 0.001 microfarads. Pulling pins 6 and 9 of the oscillator up and down turn the oscillator on and off, respectively. When the oscillator is not enabled, pin 4 remains high, causing pin 3 to remain low.

The base of NPN transistor 57, such as Model 2N3704, is also held low by way of the diode 58, such as Model 1N4454, turning off the driver oscillator. When the modulating oscillator is enabled, pin 3 of inverter A toggles high and low at a 50% duty cycle. During the half cycle pin 3 is a high, the base of transistor 57 is biased on by resistor 59 having a value such as 100K ohms, with diode 58 remaining off, allowing the driver oscillator to oscillate at the resonant frequency of the piezo-electric transducer 45 (approximately 3 KHZ).

The oscillator driving frequency is kept on resonance by a voltage feedback tab, terminal F on horn 45. The phase relationship of the feedback voltage and the drive voltage on the + input of horn 45 tends to change as the oscillator drifts away from the resonant frequency. The feedback voltage controls the conduction of transistor 57 tending to keep the oscillator at the proper frequency. The parallel connection of inductor 60 and capacitor 61 form a resonant circuit to increase the driving voltage on horn 45 to approximately 80 volts producing a peak sound power output of approximately 90 dbA at 10 feet. The inductor 60 may have a value of 18 microhenrys, and capacitor 61 may have a value of 0.047 microfarads. Diode 62 protects the base of transistor 57 from the damaging effects of negative transients. Resistor 63, connected between the feedback tab, terminal F, and the base of transistor 57 may have a value such as 10K ohms and serves to keep the voltage of the base of transistor 57 in a safe range.

In operation, the outboard motor protection alarm incorporates an integral power supply, noise maker, and trigger, with a tough polycarbonate housing. Power is obtained from a 9 volt battery which is sealed between the rear cavity of the unit and the transom of the boat. The alarm unit weights approximately 9.5 ounces without the battery. Battery life in the device is approximately equal to its shelf life. The alarm system is emitted through a piezo-electric Star horn. The electronics are sealed against corrosive elements, and its emitter diaphragm of the horn is vented to allow drainage of moisture which might collect. The alarm is a 90 Db. intermittent signal.

Installation of the alarm is accomplished by simply clamping the alarm's stainless steel contact to the boat with the outboard motor securing clamps. If further integrity to the clamping structure is desired, the entire alarm unit may be also attached directly to the transom cf the boat. The unit may be screwed to the transom at a variety of places on the alarm housing such as through the hollow sensor members previously described.

A thin metallic shorting strip (not shown) may be provided to aid in assembly. The shorting strip would be connected between sensor members 39 and 40 during assembly. When the outboard motor 20 is mounted and the clamping structure is tight, the shorting strip may be pulled loose and discarded, thereby arming the alarm unit.

The contact pads become short circuited when the motor clamps are tightened, thereby creating a circuit continuity through the clamping structure of the motor. Loosening of either clamp will cause a greater circuit resistance. A resistance greater than two meg-ohms will sound the alarm. The high resistance level is used to insure that the motor is clamped tightly to the boat. This feature will not only protect the motor from a security standpoint but also from a safety standpoint, warning of loosening through vibrations or negligance. Adjustability is achieved by rotating the mounting pads about the center of the housing to allow for manufacturer's variations in design and motor size.

While an embodiment and application of this invention has been shown and described, it will be apparent to those skilled in the art that many more modifications will be possible without departing from the inventive concepts herein described. For example, if desired, a transmitter could be included in the alarm housing to provide a coded alarm signal, when activated, to a remote battery-operated beeper or the like.

What is claimed as new and desired to be secured by Letters Patent of the United States is:

1. An alarm system powered by a portable power source for an outboard motor, said motor having an electrically conductive housing electrically coupled to electrically conductive first and second clamps for mounting the motor to a transom of a boat, said alarm system comprising:

a housing, adapted to be mounted between the first and second clamps of the outboard motor and the transom of the boat, including a first arm portion and a second arm portion:

a first electrically conductive sensor member mounted in said first arm portion and mechanically connectable to the first clamp of the outboard motor;

a second electrically conductive sensor member mounted in said second arm portion and mechanically connectable to the second clamp of the outboard motor;

a compartment in said housing for mounting the portable power source including an electrical connection for the portable power source, said compartment being inaccessible when said housing is mounted between the first and second clamps and the transom of the boat;

signalling means located in said housing for providing an alarm signal when activated, said signalling means being inaccessibly located in said housing when said housing is mounted between the first and second clamps and the transom of the boat; and circuit means inacessibly located in said housing when said housing is mounted between the first and second clamps and the transom of the boat, said circuit means being electrically connected to said first and second electrically conductive sensor means and to said electrical connection for the portable power source and to said signalling means, said circuit means providing an open circuit detection, whereby when either the first or second clamp of the outboard motor is mechanically backed off, thereby increasing the electrical resistance between the first or second clamp and the respective first or second electrically conductive sensor member, beyond a predetermined range, said signalling means is activated thereby providing the alarm signal.

2. The alarm system as in claim 1 wherein said first and second arm portions each include a cup-shaped depression and said first and second electrically conductive sensor members are respectively mounted in one of said cup-shaped depressions.

3. The alarm system as in claim 2 wherein said first and said second sensor members each include a hollow portion adapted to receive a fastening means for mechanically attaching said housing to the transom of the boat.

4. The alarm system as in claim 2 wherein said housing includes a central pivot portion, said first and second arm portions being adjustably connected to said central pivot portion such that the centerline distance between said first and second electrically conductive sensor members is adjustable for mating with the fixed center line distance between the first and second clamps of the outboard motor.

5. The alarm system as in claim 1 wherein said circuit means provides full time current sensing for continuously sampling for electrical discontinuity.

6. The alarm system as in claim 5 wherein said circuit means includes circuitry for providing a resistive sensitivity setting.

7. The alarm system as in claim 6 wherein said circuit means includes an integrated circuit portion, said intergrated circuit portion being encapsulated.

8. The circuit means as in claim 7 wherein said circuit means includes circuitry for noise filtering.

9. The alarm system as in claim 1 wherein said signalling means included a horn for providing an audible alarm signal when activated.

10. The alarm system as in claim 9 wherein said horn comprises a diaphragm horn mounted in said central pivot portion of said housing, central pivot portion of said housing including a shield member proximate said diaphragm horn for substantially preventing puncture of said diaphragm horn through said central pivot portion of said housing.

11. The alarm system as in claim 1 wherein said housing is formed of a polycarbonate.

12. An alarm system comrpising:

an outboard motor having an electrically conductive housing electrically coupled to electrically conductive first and second clamps for mounting said motor to a transom of a boat;

a housing mounted between said first and second clamps of said outboard motor and the transom of the boat, said housing including a first portion and a second portion;

a first electrically conductive sensor member mounted in said first portion of said housing and mechanically connected to said first clamp of said outboard motor;

a second electrically conductive sensor member mounted in said second portion of said housing and mechanically connected to said second clamp of said outboard motor;

a portable power source inaccessibly mounted in said housing;

signalling means inaccessibly mounted in said housing for providing an alarm signal; and circuit means inaccessibly mounted in said housing, said circuit means being electrically connected to said first and second electrically conductive sensor member and to said portable power source and to said signalling means, said circuit means providing an open circuit detection, whereby when either said first or said second clamp of said outboard motor is mechanically backed off, thereby increasing the electrical resistance, beyond a predetermined range, between either said first of said second clamp and said respective first or said second sensor member, said signalling means is activated and an alarm signal is provided.

13. The alarm system as in claim 12 wherein the portable power source is a battery.

14. The alarm system as in claim 13 wherein said circuit means includes circuitry for continuously sampling for electrical discontinuity.

15. The alarm system as in claim 14 wherein said circuit means includes circuitry for providing a resistive sensitivity setting.

16. The alarm system as in claim 12 wherein said signalling means includes a diaphragm horn for providing an audible alarm signal when activated, said housing including a shield member proximate said diaphragm horn for substantially preventing puncture of said diaphragm horn through said housing.

17. A self-contained, battery powered alarm system for an outboard motor, said motor having an electrically conductive housing electrically coupled to electrically conductive first and second clamps for mounting the motor to a transom of a boat, said alarm system comprising:

a housing, adapted to be mounted between the first and second clamps of the outboard motor and the transom of the boat, including a first arm portion and a second arm portion, said housing including a central pivot portion, said first and second arm portions including a first and second cup-shaped depression respectively, said first and second arm portions being adjustably connected to said central pivot portion;

a first electrically conductive sensor means mechanically mounted in said first cup-shaped depression in said first arm portion and connectable to the first clamp of the outboard motor;

a second electrically conductive sensor means mechanically mounted in said second cup-shaped depression in said second arm portion and connectable to the second clamp of the outboard motor;

a compartment in said housing for mounting and providing an electrical connection for the battery, said compartment being inaccessible when said housing is mounted between the first and second clamps and the transom of the boat;

signalling means located in said housing for providing an alarm signal when activated, said signalling means being inaccessibly located in said housing when said housing is mounted between the first and second clamps and the transom of the boat; and circuit means inaccessibly located in said housing when said housing is mounted between the first and second clamps and the transom of the boat, said circuit means being electrically connected to said first and second electrically conductive sensor means and to said electrical connection for the battery and to said signalling means, said circuit means providing an open circuit detection, whereby when either the first or second clamp of the outboard motor is mechanically backed off, thereby increasing the electrical resistance between the first or second clamp and the respective first or second electrically conductive sensor member, beyond a predetermined range, said signalling means is activated thereby providing the alarm signal.

18. The alarm system as in claim 17 wherein said circuit means provides circuitry for continuously sampling for electrical discontinuity.

19. The alarm system as in claim 18 wherein said signalling means includes a diaphragm horn mounted in said central pivot portion of said housing, said central pivot portion of said housing including a shield member for substantially preventing puncture of said diaphragm horn through said central pivot portion of said housing.

20. The alarm system as in claim 17 wherein said first and second sensor means each includes an aperture adapted to receive fastening means for mechanically securing said housing to the transom of the boat.

* * * * *